United States Patent [19]

Joseph

[11] Patent Number: 5,016,875

[45] Date of Patent: May 21, 1991

[54] PORTABLE BASKETBALL RETRIEVAL APPARATUS

[76] Inventor: John Joseph, 3305 C.H. 47, Upper Sandusky, Ohio 43351

[21] Appl. No.: 512,164

[22] Filed: Apr. 20, 1990

[51] Int. Cl.[5] ..... A63B 69/00

[52] U.S. Cl. ..... 273/1.5 A

[58] Field of Search ..... 273/1.5 R, 1.5 A, 396, 273/397; D21/201

[56] References Cited

U.S. PATENT DOCUMENTS

| | | | |
|---|---|---|---|
| 3,025,058 | 3/1962 | Brumfield | 273/1.5 R |
| 4,667,957 | 5/1987 | Joseph | 273/1.5 A |
| 4,913,431 | 4/1990 | Jakobs | 273/1.5 A |
| 4,936,577 | 6/1990 | Kington et al. | 273/1.5 A |
| 4,940,231 | 7/1990 | Ehler | 273/1.5 A |

*Primary Examiner*—Paul E. Shapiro
*Attorney, Agent, or Firm*—George C. Atwell

[57] ABSTRACT

A free-standing, portable basketball retrieval and return apparatus for collecting and returning a succession of shot basketballs to a practicing player includes a vertically-extensible and collapsible support frame, support arms pivotally connected to the support frame, and netting material attached to the support arms for retrieving and collecting shot basketballs and a chute permanently secured to the netting material for directing retrieved basketballs therethrough to a guideway. The basketballs are then directed from the guidewall to an elongated, extensible ramp and therealong to a ramp barrier whereupon the practicing player can retrieve the returned basketballs in order to continue uninterrupted practice shooting. Means are provided, preferably in the form of wheels, which, in combination with the collapsible support frame, enables movement of the apparatus as a unit between its operative position and a storage location as a one-man operation. The apparatus is adapted for use with a pole- or wall-mounted backboard or, alternatively, with a backboard member which is removably secured to the top of the support frame in a position substantially in the same vertical plane as the support frame.

23 Claims, 4 Drawing Sheets

PORTABLE BASKETBALL RETRIEVAL APPARATUS

BACKGROUND OF THE INVENTION

The present invention relates generally to devices used for basketball practice shooting, and more particularly pertains to apparatus for disposition beneath the basketball backboard that can retrieve and return shot basketballs to a practicing player.

The prior art discloses a number of devices which facilitate basketball practice shooting, such devices comprehending surface-supportable apparatus which returns consecutively shot basketballs to a player or players standing at various locations and distances from the basketball backboard and hoop.

Among the pertinent prior art developments are the inventions disclosed in U.S. Pat. Nos. 4,697,810 (Mathison), 4,786,371 (Postol), and 4,838,549 (Woodall).

The aforementioned patents disclose surface-supportable devices for disposition beneath a basketball backboard for directing basketballs which pass through the basketball hoop to a basketball shooter. Such devices have various means to collect errant and ricocheted basketball shots and can also direct such shots to a practicing basketball player. These results are achieved in the Mathison art by a paneled enclosure, a funnel-shaped collection device, and return chute; in the Postol art by a downwardly-inclined net-carrying frame supported at its lower end by foldable legs; and in the Woodall art by a three-sided elongated paneled chute, a cradle, and an extensible ramp member.

Although each of the devices taught in the aforementioned patents are characterized by specific features generally beneficial to the avid practicing basketball player, there remains a need for a more efficient portable and collapsible basketball retrieval and return apparatus which can be relatively inexpensively manufactured and which offers certain structural and functional advantages not previously available.

SUMMARY OF THE INVENTION

The present invention comprehends an apparatus for retrieving and returning shot basketballs to a practicing player, and fulfills a number of desirable objectives, including ease of assembly and disassembly, a means for storage and transportation, and inexpensive cost of manufacture.

In addition to the above, the structure of the present invention achieves the objective of ease in assembly and disassembly by comprising elements whose manipulation does not require tools of any kind or great physical strength.

Another important objective accomplished by the present invention is that it can be adapted to retrieve and return basketballs shot from various angles and positions on the playing surface.

A still further and equally important objective accomplished by the present invention is that its disposition does not require permanent physical attachment to the basketball backboard or rim, thus allowing efficient transportation to different playing areas. Also, the apparatus is transportable as a unit by an individual, a feature which enhances its salability.

Yet another advantage of the present invention is that it can be used with or without a wall-, ceiling-, or pole-mounted basketball backboard and rim. The preferred embodiment of the present invention has an easily attachable and removable backboard member comprising a backboard, a rim, and a net that permits basketball practice shooting when a pole-, wall-, or ceiling-mounted backboard and rim is unavailable. In the alternative embodiment of the invention, the same structure can be adapted for use with a free-standing pole-, wall-, or ceiling-mounted backboard.

The basketball return and retrieval apparatus of the present invention includes a vertically-extensible and collapsible support frame, the support frame being collapsible to a vertical plane so that manual transportation and storage of the apparatus is easily achieved. Telescopically extensible support arms are pivotally connected to the support frame which further includes means to selectively receive and support a backboard member.

When the apparatus is disposed in its operative position, netting material attached to the support arms retrieve and collect basketballs shot by the player and directs the basketballs to a lower end of an inwardly-converging, funnel-shaped portion of the netting material, and thence to a chute permanently secured to the netting material. A guideway attached beneath the chute receives the basketballs therefrom, and then directs the basketballs to an elongated ramp terminating at a ramp upright. The path of the basketballs is halted by a ramp barrier attached to the ramp upright, whereupon the player can retrieve the basketball and continue shooting. The structure of the present invention also includes a stabilizing member and means to facilitate manual movement of the apparatus in its collapsed disposition.

More specific details of the structure of the presently preferred embodiment of the invention are set forth in the ensuing detailed description and shown in the accompanying drawings, a full understanding of which will enable an appreciation of the advantages and features of the disclosed invention.

DETAILED DESCRIPTION OF THE PREFERRED EMBODIMENT

Figure 1:
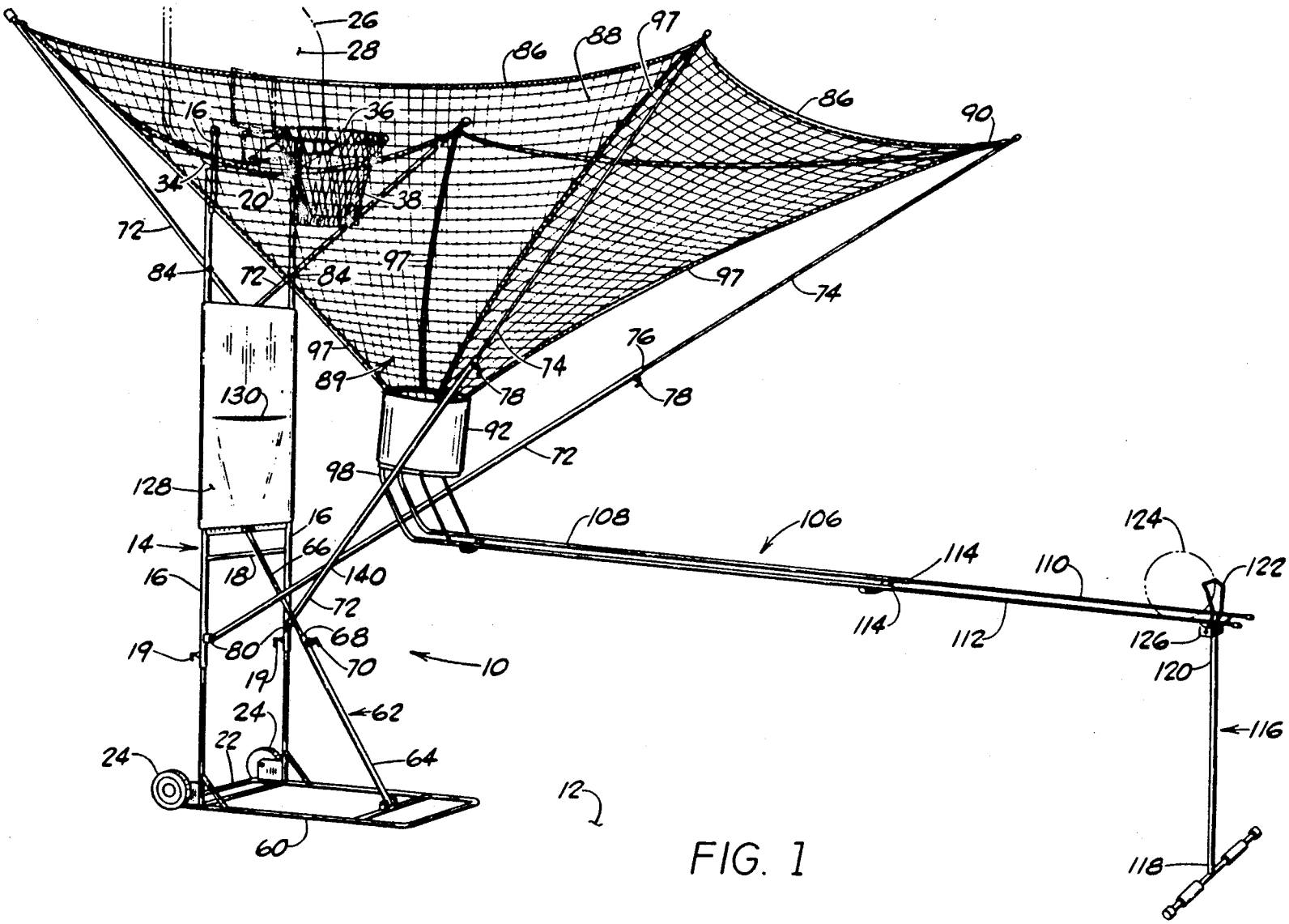
FIG. 1 is an isometric side view of a free-standing basketball retrieval and return apparatus embodying the present invention.

Referring to the drawings, FIG. 1 shows a manually transportable, free-standing basketball retrieval and return apparatus 10 for disposition on a playing surface 12. The playing surface 12 can be either indoors or outdoors. The basketball retrieval and return apparatus 10 includes a vertically-extensible support frame 14.

The support frame 14 includes a plurality of vertical, spaced-apart upright members 16 and a plurality of spaced-apart, horizontal crosspieces 18 fixed, at intervals, to the upright members 16. The vertical upright members 16 and the horizontal crosspieces 18 are manufactured to be lightweight, durable, and yet rigid. This facilitates ease of assembly and transportation of the basketball retrieval and return apparatus 10.

The upright members 16 are secured at the desired height by slidably moving each upright member 16 up or down until the appropriate height is attained, and then securing the upright members 16 in position by tightening a pair of vertical adjustment screws 19. The support frame 14 is further defined by a topmost horizontal crosspiece 20 and a bottom horizontal crosspiece 22, which is adjacent the playing surface 12. It is contemplated that the apparatus of the present invention will be provided with a means for manually transporting the apparatus to facilitate moving the apparatus 10 as a unit, and as a one-man operation. In the preferred embodiment of the present invention, the manual transportation means are a pair of oppositely-disposed wheels 24 attached to the bottom horizontal crosspiece 22.

When manual movement and storage is required, the pivotally-connected support arms (hereinafter further described) are positioned adjacent to and generally in the same vertical plane as the support frame 14. The upright members 16 are slidably moved to a position equal in height to the topmost horizontal crosspiece 20 and the netting material is returned to its storage position within the pouch or envelope (the netting material and the pouch shall be hereinafter more specifically described). Thus, the support frame 14 and elements attached to the support frame 14 are collapsed and positioned in generally the same vertical plane. The collapsibility of the support frame 14 to a single vertical plane allows an unassisted individual to manually move and store the apparatus 10 as shown in FIG. 1.

The basketball retrieval and return apparatus 10 is of a lightweight construction and, therefore, the relatively small pair of wheels 24 can easily bear the weight of the apparatus 10 during location adjustment on a playing surface 12 and transportation to a different playing surface or a storage area.

Figure 2:
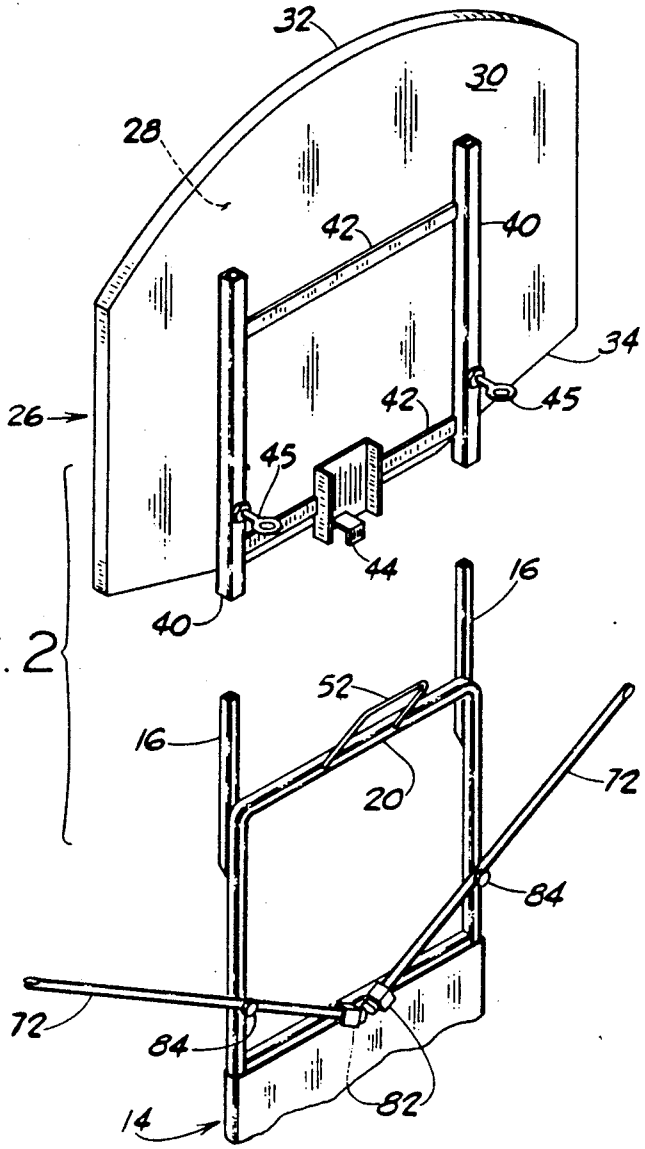
FIG. 2 is a partial back view of the apparatus first disclosed in FIG. 1.

As shown in FIGS. 1 and 2, the basketball retrieval and return apparatus 10 includes a selectively removably attachable backboard member 26. The backboard member 26 is essentially a lightweight, durable basketball backboard that attaches to the top of the support frame 14. The backboard member 26 includes a backboard playing side 28, a backboard backside 30, a top edge 32, and a bottom edge 34. In addition, the backboard member 26 has a transversely extending backboard member rim 36 with a backboard member net 38 attached thereto. The backboard member 26 has fixed on its backside 30 a pair of spaced-apart hollow vertical supports 40 and a pair of spaced-apart horizontal supports 42. Further, as illustrated in FIG. 2, a mounting hook 44 is fixed to the backboard member backside 30. In order to attach the backboard member 26 to the support frame 14, the hollow vertical supports 40 are slidably engaged over the upright members 16, as shown in FIG. 2. Located on each of the hollow vertical supports 40 are backboard attachment screws 45. After slidably engaging the vertical supports 40 over the upright members 16, the backboard attachment screws 45 are tightened adjacent the upright members 16 to insure that the backboard member 26 will not loosen or sway during basketball practice shooting.

Figure 4:
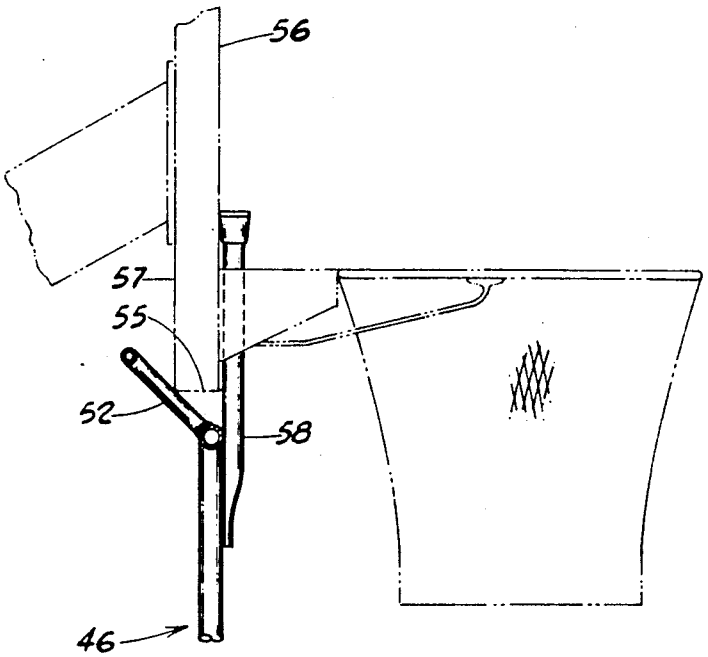
FIG. 4 is an enlarged side elevational view of the alternate embodiment of the apparatus disclosed in FIG. 3 showing certain elements of the apparatus used in combination with a basketball backboard, rim, and net shown in phantom lines.
Figure 3:
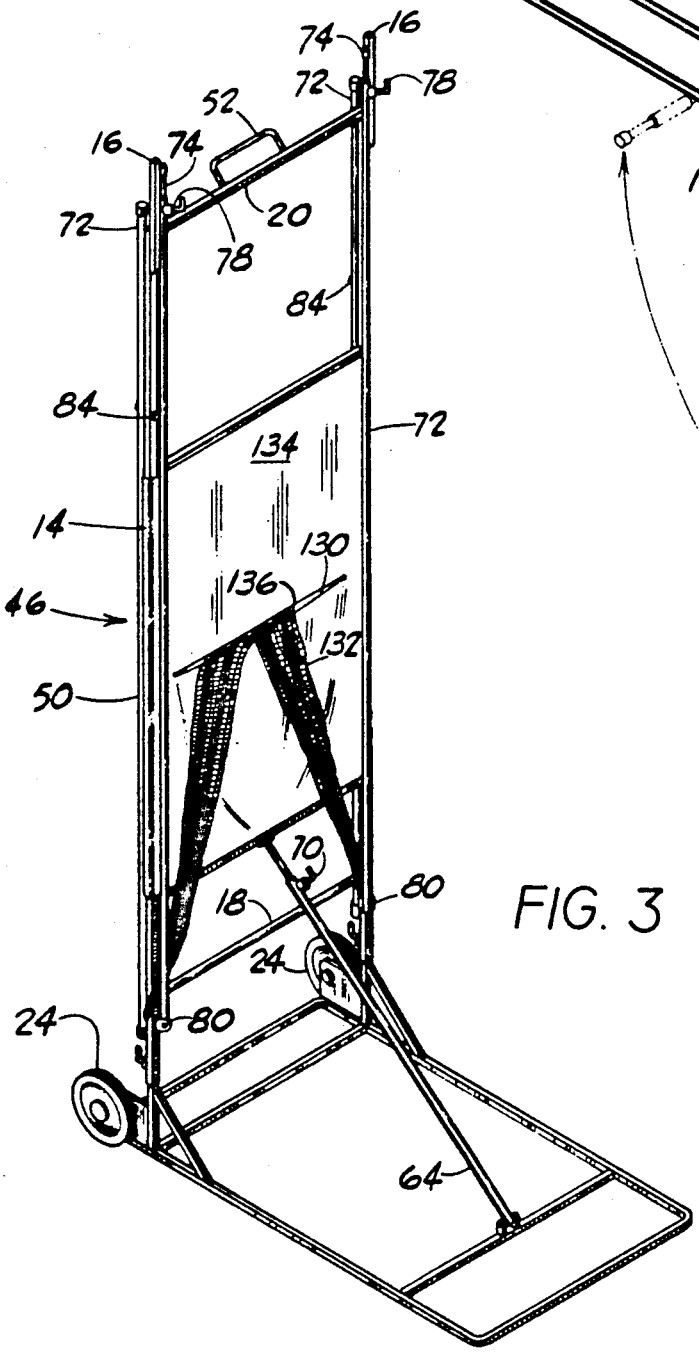
FIG. 3 is a frontal perspective view of an alternate embodiment of the apparatus disclosed in FIG. 1.

FIGS. 3 and 4 illustrate a modified form or alternate embodiment of the present invention. In FIG. 3 is shown a basketball retrieval and return apparatus 46 disposed in its storage position. Attached to the topmost horizontal crosspiece 48 of the support frame 50 is a rigid, rearwardly-extending projection 52. In this alternate embodiment, as shown in FIG. 3, the support frame 50 is disposed between a playing surface 54 and a basketball backboard. When utilizing the apparatus 46 in its alternate embodiment, the basketball backboard may be pole-mounted, ceiling-, or wall-mounted. In order to commence basketball practice shooting, a wedging means is employed to secure the support frame 50 to the basketball backboard. More specifically, the wedging means is accomplished in the alternate embodiment, as shown in FIG. 4, by first positioning the rearwardly-extending projection 52 underneath the lower edge 55 of a pole-mounted basketball backboard 56. Then the rearwardly-extending projection 52 is manually and forcibly wedged underneath the pole-mounted basketball backboard 56 as shown in FIG. 4. When the apparatus 46 is disposed in its operative position of this alternate embodiment, the rearwardly-extending projection 52 will extend a relatively short distance in behind the pole-mounted basketball backboard's rear side 57, and the vertical upright members 58 will project a relatively short distance above the lower edge 55 of the frontside of the basketball backboard. This combination thus secures the support frame 50 to the basketball backboard 56. The projection 52 also serves the secondary function of a handle for manually positioning the entire apparatus 10.

It should be noted that the alternate embodiment of the apparatus 46 as shown in FIGS. 3 and 4 is adapted from the structure of the preferred embodiment of the apparatus 10 as illustrated in FIG. 1. This enhances the utility of the apparatus of the present invention in that two unique embodiments of the invention are contained within the same structure. Moreover, all that is required to manually move the apparatus 10 in the preferred embodiment, or the apparatus 46 in the alternate embodiment, is for the practicing player to collapse the support frame 14 and the attached elements to a generally vertical plane, tilt the support frame 14 away from its upright vertical posture and then manually grasp the rearwardly-extending projection and either pull or push the invention to the desired location.

Referring again to FIG. 1, a stabilizing member 60 protrudes at an angle, generally 90°, from the support frame 14 and is integrally attached thereto. The stabilizing member 60 extends outwardly from the support frame 14 and is adjacent the playing surface 12 and it assists maintaining the vertical posture of the support frame 14, when the apparatus 10 is disposed in its operative position.

In FIG. 1, there is shown an elongated hollow support brace 62 which also serves to enhance the stability of the apparatus 10 when disposed in the operative position. Referring to FIG. 1, the elongated support brace 62 has a hollow first end 64 attached to the stabilizing member and a second end 66 attached to the horizontal crosspiece 18. The elongated support brace 62 can retract or extend to accommodate the vertical extension of the support frame 14 whereby the second end 66 is slidably received within the hollow first end 64 through a support brace aperture 68 for extension or retraction. After the support frame 14 is vertically extended to its desired height for basketball practice shooting, and the support brace 62 is extended or retracted to the appropriate length, an L-shaped support bolt 70 is tightened, thus securing the support brace 62 in its elongated disposition.

As illustrated in FIG. 1, a plurality of hollow, elongated, telescopically-extensible support arms 72, pivotally connected to the support frame 14 and also attachable behind the support frame 14, are shown disposed in their operative position. When disposed in their operative position, the support arms 72 extend outward and away from the basketball backboard's playing side, and toward a practicing player, and also the support arms 72 extend outwardly and laterally behind the basketball backboard.

As shown in FIG. 1, each of the support arms 72 are retractably extensible in combination with a support arm inner member 74 which slidably engages the support arm 72 for retraction or extension. The support arm inner members 74 are inserted in the hollow support arms 72 through a support arm opening 76. As shown in FIG. 1, when the apparatus 10 is disposed in its operative position, the support arms 72 extend outwardly from the support frame 14. The support arm inner members 74 are then manually extended or retracted by a telescoping action in order to achieve the desired length for the practice shooting, and then a support arm bolt 78 is tightened, thus locking in position the support arm inner members 74. Pivot members 80, as illustrated in FIG. 1, permit the attached support arms 72 to outwardly extend from the generally vertical plane of the support frame 14 whereby their outer ends can be adjustably moved through an arc of generally 180°. As illustrated in FIG. 1, the pivot members 80 are attached to the upright members 16 of the support frame 14.

In addition, as illustrated in FIG. 2, a pair of support arm clasps 82 are provided in order to secure the support arms 72 that extend outwardly and laterally from behind the support frame 14. When the apparatus 10 is disposed in its operative position, the support arms 72 are inserted through the support arm clasps 82. For further securement, a pair of support frame fasteners 84 are inserted through the support arms 72 in order to secure the support arms 72 to the upright members 16 of the support frame 14.

FIG. 1 shows a stretched netting material 86 disposed in its operative position. The stretched netting material 86 is lightweight, durable, pliant, and serves to retrieve and collect basketballs shot from a practicing player. When the stretched netting material 86 is disposed in its operative position, as shown in FIG. 1, it defines a basketball retrieval and collection area 88. In addition, the netting material 86, when disposed in its operative position, further defines a funnel-shaped collector with an upper end 89 generally level to the bottom edge 34 of the backboard member 26 and an inwardly and downwardly-converging lower end 90. Consequently, shot basketballs that fall cleanly through the rim as well as basketballs that strike the backboard and ricochet off in various directions are collected and retrieved by the stretched netting material 86. In addition, the stretched netting material 86 is attached to the support arms 72 by netting rings or hooks 91 located at the point of furthest extension of the support arms 72.

As illustrated in FIG. 1, the support arms 72 and the stretched netting material 86 extend to, and are generally the same height as, the support frame 14 and the backboard member rim 36. However, the support arms 72 have the capability, by being pivotally adjustable and retractably extensible, to vary the basketball collection and retrieval area 88 and also to vary the shape, through broadening or narrowing, of the funnel-shaped collector. This is advantageous because if the practicing player is shooting free throws from the foul line, he may want the support arms 72 to extend substantially above the backboard member rim 36, thus narrowing the basketball retrieval and collection area 88, and causing the upward elongation of the funnel-shaped collector. This operative disposition would be desired during stationary shooting from the foul line directly in front of the basketball backboard member 26.

However, if the practicing player desires to shoot from positions around the backboard member 26, which would increase the area on the backboard member 26 to be struck by the shot basketballs, and would also increase the angles from which the basketballs would ricochet away from the backboard member 26, a different disposition of the support arms 72 and the netting material 86 is required. Specifically, the support arms 72 would be disposed substantially beneath the backboard member rim 36 in order to enlarge the basketball retrieval and collection area 88. In addition, this would flatten and broaden the funnel-shaped collector, thus increasing the number of shot basketballs which would be collected and retrieved by the apparatus.

As shown in FIG. 1, a chute 92 is permanently secured to the stretched netting material 86 at the downwardly-converging lower end 90, for receiving the shot basketballs that fall from a basketball hoop or rim. More specifically, as illustrated in FIG. 5, the chute 92 comprises a chute supporting member 94 which defines a chute opening 96.

In addition, as illustrated in FIG. 1, a plurality of elastic, flexible cords 97 stretch between, and are secured to, the chute 92 and the furtherest extension of the support arms 72. Moreover, the stretched netting material 86 is integrally affixed to the flexible cords 97 at numerous points therealong.

When the apparatus is disposed in its operative position, as illustrated in FIG. 1, shot basketballs are collected and retrieved by the stretched netting material 86. The basketballs are directed downwardly to the lower end 90 of the netting material 86. The basketballs are further downwardly directed from the lower end 90 therethrough the chute opening 96. Furthermore, as illustrated in FIG. 1, when the chute 92 is disposed in its operative position, the chute 92 is located beneath the retrieval and collection area 88 of the stretched netting material 86.

Figure 5:
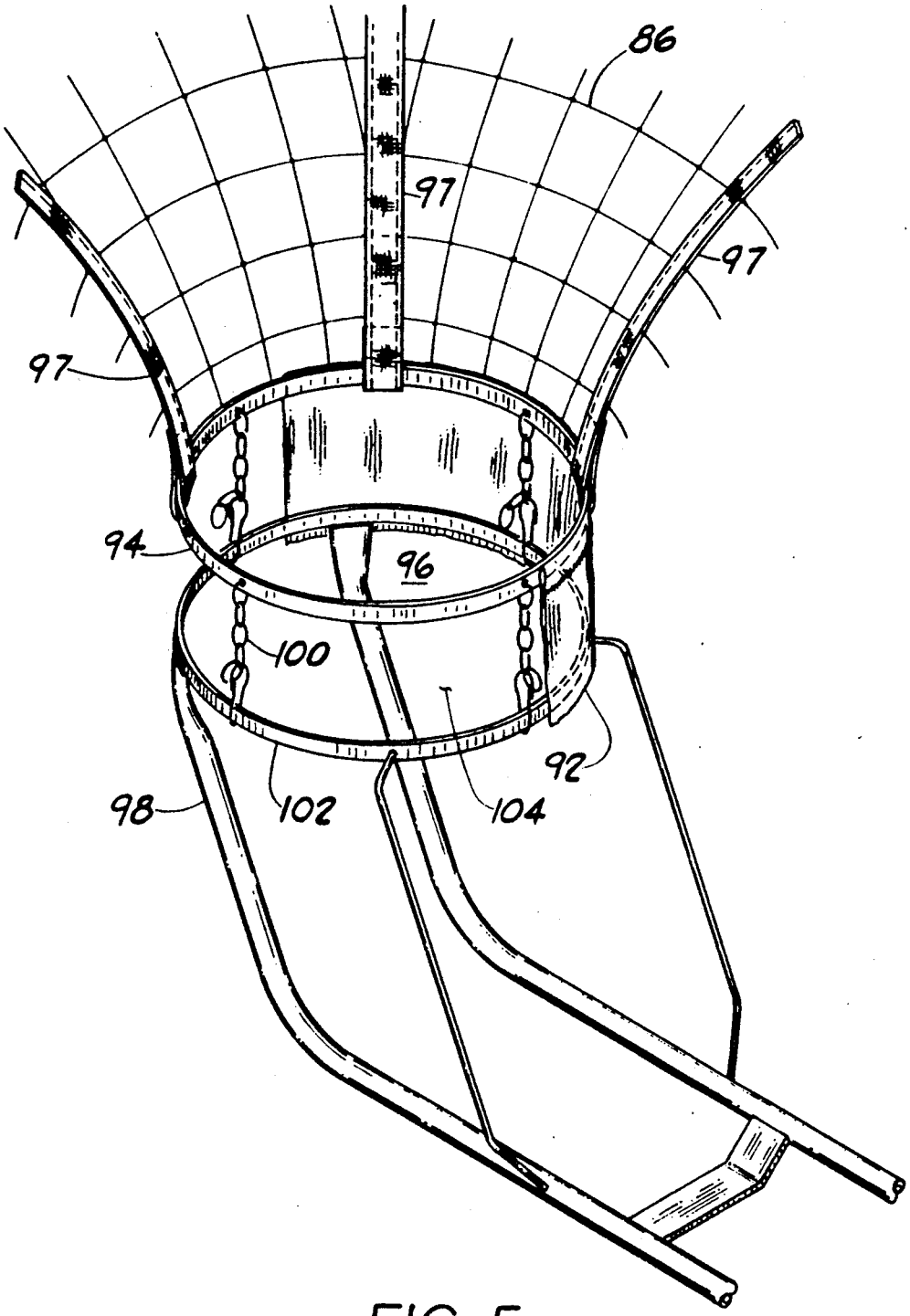
FIG. 5 is an enlarged fragmentary view illustrating certain elements of the apparatus first shown in FIG. 1.

As shown in FIGS. 1 and 5, a guideway 98 is located at a point intermediate the playing surface 12 and the chute 92, and further defines a passageway for the shot basketballs. The guideway 98 has a means of attachment to the chute 92, more particularly, as shown in FIG. 5, interconnecting chain links 100 depending from the chute supporting member 94 are attached to a guideway circular support 102. Moreover, the interconnecting chain links 100 can be slidably securable to the guideway circular support 102, as shown in FIG. 5.

When the apparatus 10 is disposed in its operative position, as illustrated in FIG. 1, the guideway 98 is attached to and located beneath the chute 92. During practice shooting, shot basketballs either fall through the backboard rim 36 or ricochet off the basketball backboard playside 28; they are then collected and retrieved by the stretched netting material 86, funneled through the lower end 90 and directed to the chute 92, and, as more specifically shown in FIG. 5, are thereupon directed through the chute opening 96 to the guideway 98. More specifically, as shown in FIG. 5, the guideway 98 includes a guideway circular support 102 which defines a guideway passage 104. Shot basketballs pass through the chute opening 96 and to the guideway passage 104, whereupon the shot basketballs are then directed through the guideway passage 104, the downward direction of the shot basketballs being, of course, effected by the force of gravity.

Figure 6:
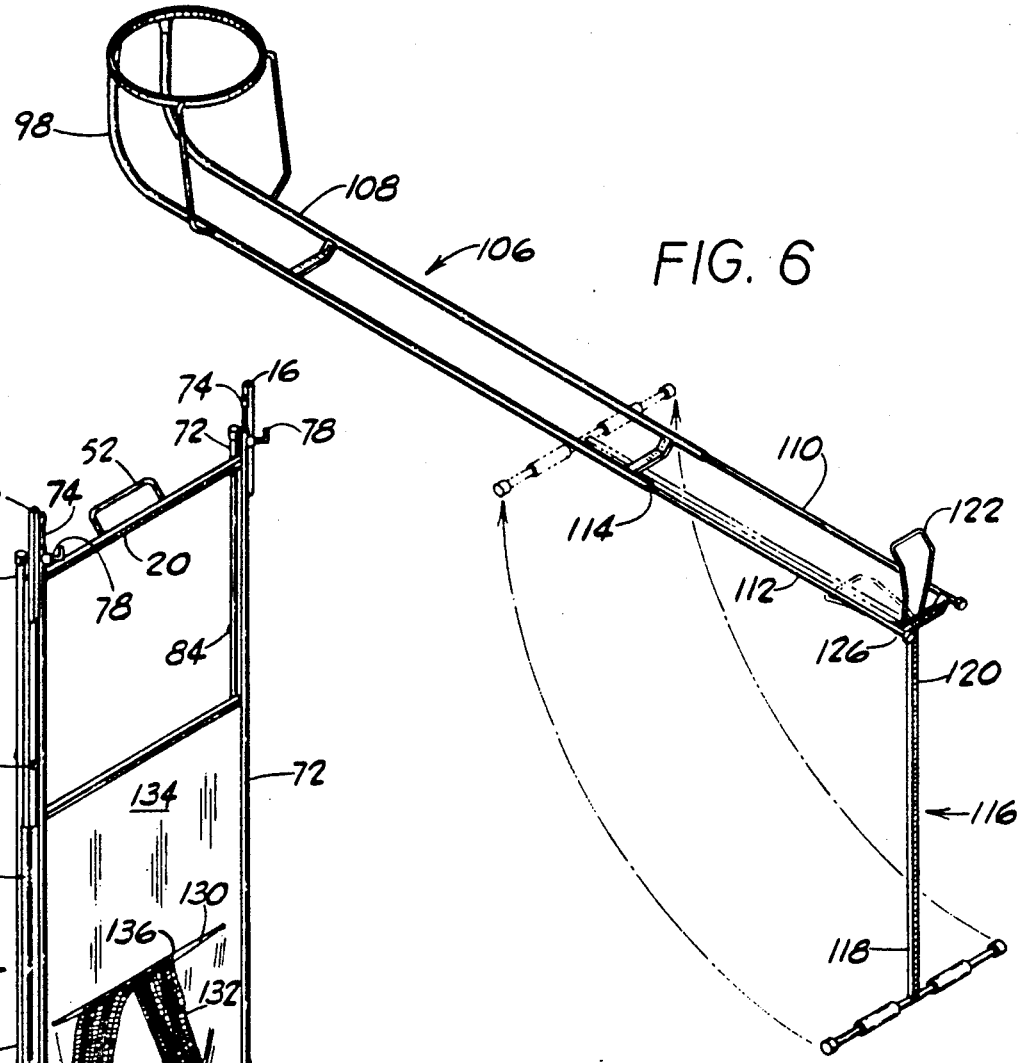
FIG. 6 is an enlarged frontal perspective view of certain elements of the apparatus first disclosed in FIG. 1.

As illustrated in FIGS. 1 and 6, there is shown an elongated, extensible hollow ramp 106. The elongated, extensible ramp 106 is integrally connected to the guideway 98 and includes a proximate ramp end 108 and a distal ramp end 110. The ramp 106 is capable of extension or retraction by having a ramp insertion member 112 slidably inserted within the hollow ramp 106 through the ramp extension opening 114. When the apparatus 10 is disposed in its operative position, the basketball player determines the distance he wishes to shoot from and then extends or retracts the ramp insertion member 112 of the ramp 106 to accommodate the particular shooting distance the basketball player has chosen.

When the apparatus 10 is disposed in its operative position, as shown in FIG. 1, shot basketballs are received by the guideway 98 and directed to the integrally connected ramp 106. The ramp 106 is declined slightly downward from the horizontal in order to allow a basketball to roll therealong. A practicing player stands at the distal ramp end 110 in order to retrieve the basketballs that are directed along the ramp 106.

As illustrated in FIGS. 1 and 6, there is shown a ramp upright 116 attached to the elongated, extensible ramp 106. The ramp upright 116 includes a first ramp upright end 118 and a second ramp upright end 120. In addition, the ramp upright 116 includes a ramp barrier 122 which projects transversely to the extension of the ramp 106, and which serves to stop or halt the movement of a rolling basketball 124, as shown in FIGS. 1 and 6, directed along the ramp 106. As shown in FIGS. 1 and 6, the ramp upright 116 has a means for storage and disposition. The storage and disposition means includes a pivotal hinge member 126 that connects the ramp upright 116 to the ramp 106. During periods of storage or transportation of the apparatus 10 shown in FIG. 1 to different playing surfaces or areas, the ramp upright 116 can be pivoted upward by the hinge member 126 or a position adjacent to and generally parallel with the elongated, extensible ramp 106.

To the support frame 14, as illustrated in FIG. 1, there is attached a storage envelope or pouch 128. The storage envelope 128 is attached to the vertical upright members 16 of the support frame 14, generally in the same vertical plane as the support frame 14. The envelope 128 is made of a durable and flexible material, such as plastic, and has, located generally toward the middle, an envelope or pouch opening 130, which, as shown more specifically in FIG. 1, is on the front side of the support frame 14.

More specifically, as shown in FIG. 3, which is the alternate embodiment of the present invention shown in its storage position, a stretched netting material 132 is stored within an envelope 134 by being first received through an envelope opening 136. In addition, when the apparatus 46 is disposed in its storage position, the chute 138 (not shown) which is permanently secured to the stretched netting material 132, is also stored within the envelope 134.

Additional stability can be provided to the support arms 74 by depending them, one to the other, at their point of crossover (designated in FIG. 1 as 140) through use of a removable bracket (not shown) or other tying means which can be removed when the structure is collapsed for repositioning or storage.

While the free-standing basketball retrieval and return apparatus has been described in connection with the preferred embodiments, it is not intended to limit the invention to the particular form set forth, but, on the contrary, it is intended to cover such alternatives, modifications, and adaptations, as may be included within the spirit and scope of the invention as defined by the appended claims.

I claim:

1. A free-standing basketball retrieval and return apparatus comprising:

a portable vertically-extensible and collapsible support frame for vertical orientation on a playing surface;

a plurality of support arms pivotally connected to the support frame;

stretched netting material attached to the support arms for extension therebetween to form a funnel-shaped collector with an inward and downwardly converging end;

a chute for receiving basketballs from a basketball hoop on the backboard and guiding the basketballs therethrough, the chute being secured to the converging end of the collector;

a guideway located below the chute and defining a passageway for the basketballs;

an elongated, extensible ramp oriented to receive basketballs from the guideway and serving to direct basketballs, received from the guideway, along the ramp's length from a proximate ramp end to a distal ramp end; and means on the support frame for selective attachment of a backboard member at the top of the support frame to project upwardly in the same general vertical plane of the support frame, for use in basketball practice shooting.

2. The apparatus of claim 1 wherein the support frame includes a plurality of vertical, spaced-apart upright members, and a plurality of spaced-apart horizontal crosspieces fixed to the upright members.

3. The apparatus of claim 2 further comprising wheel means on the support frame and disposed to engage the playing surface when the support frame is tilted away from its vertical orientation.

4. The apparatus of claim 2 further comprising a rigid stabilizing member projecting transversely from the lower end of the support frame and an elongated support brace, adapted for retraction and extension, having a first end secured to the stabilizing member and a second end secured to one of the horizontal crosspieces of the support frame for maintaining the upright vertical posture of the apparatus when it is disposed in its operative position.

5. The apparatus of claim 1 wherein the backboard member includes a playing side, a backside, a pair of spaced-apart hollow vertical supports, a pair of horizontal supports, the vertical and horizontal supports secured to the backside; and a means to attach the backboard member to the support frame.

6. The apparatus of claim 5 wherein the means for attachment includes the hollow vertical pieces being slidably engaged over the upright members of the support frame and a mounting hook securably located on the backboard member backside and secured to a horizontal crosspiece of the support frame.

7. The apparatus of claim 1 wherein the support arms are retractably extendable.

8. The apparatus of claim 1 wherein the stretched netting material is of a pliant construction and is fastened to the support arms by means of a plurality of elastic, flexible cords, the flexible cords secured therebetween the chute and the support arms.

9. The apparatus of claim 1 wherein the stretched netting material, when disposed in its operative position, defines a basketball collection and retrieval area for the shot basketballs and an upper end of the funnel-shaped collector is generally at the level of the lowermost edge of the backboard member.

10. The apparatus of claim 9 wherein the support arms are capable of varying the size and shape of the funnel-shaped collector and the basketball collection and retrieval area.

11. The apparatus of claim 1 wherein the chute is disposed vertically between the playing surface and the top of the support frame, the chute has a circular supporting member which defines an opening for receiving basketballs collected and retrieved by the netting material, and the opening permitting passage of basketballs therethrough to the guideway.

12. The apparatus of claim 1 which includes means to secure the chute to the guideway.

13. The apparatus of claim 1 wherein the ramp includes a rigid ramp upright, the ramp upright having a first end resting on the playing surface and a second end attached adjacent the distal end of the ramp opposite the support frame.

14. The apparatus of claim 13 wherein the ramp upright includes a barrier attached to the ramp upright projecting upwardly from the ramp for halting a basketball rolling thereon.

15. The apparatus of claim 13 wherein the ramp upright includes pivotal means for storage of the ramp upright generally in the same plane as the ramp.

16. The apparatus of claim 1 wherein the support frame includes a stabilizing member that protrudes at an angle from the support frame.

17. The apparatus of claim 1 wherein the ramp is retractably extensible.

18. The apparatus of claim 1 including means on the support frame for storage of the netting material.

19. The apparatus of claim 18 wherein the storage means is a pouch constructed of flexible material and attached to the support frame, the pouch having an opening permitting manual insertion and removal of the netting material and the chute.

20. The apparatus of claim 18 wherein the storage means constitutes a flexible envelope contained substantially within the plane of the support frame.

21. A basketball retrieval and return apparatus comprising:

a portable, vertically-extensible rectilinear frame for disposition between a playing surface and a basketball backboard in a vertical position generally in the vertical plane of the basketball backboard;

a plurality of support arms pivotally connected to the support frame;

stretched netting material attached to the support arms for extension therebetween;

a chute for receiving basketballs from a basketball hoop on the backboard and guiding the basketballs therethrough, the chute being secured in registration with an opening to the netting material;

a curvilinear guideway located at a point intermediate the playing surface and the chute and defining a passageway for the basketballs; and an elongated, extensible ramp integrated with the guideway and serving to direct basketballs, received from the guideway, along the ramp's length from a proximate ramp end to a distal ramp end.

22. The apparatus of claim 21 further comprising a wedging means to removably secure the support frame to the bottom edge of the basketball backboard.

23. The apparatus of claim 21 wherein the means to removably secure includes a rigid, rearwardly-extending projection adapted to overlap one side of the backboard and disposed between the top of the support frame and the bottom of the basketball backboard, whereupon securement is accomplished by wedging the projection against the bottom edge of the basketball backboard.

* * * * *